US009765419B2

(12) United States Patent
Yan et al.

(10) Patent No.: US 9,765,419 B2
(45) **Date of Patent: *Sep. 19, 2017**

(54) METHODS FOR ARTIFICIALLY AGING ALUMINUM-ZINC-MAGNESIUM ALLOYS, AND PRODUCTS BASED ON THE SAME

(71) Applicant: ALCOA USA CORP., Pittsburgh, PA (US)

(72) Inventors: Xinyan Yan, Murrysville, PA (US); Wenping Zhang, Murrysville, PA (US); Dana Clark, Apollo, PA (US); James Daniel Bryant, Murrysville, PA (US); Jen Lin, Export, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 413 days.

This patent is subject to a terminal disclaimer.

(21) Appl. No.: 14/206,448

(22) Filed: Mar. 12, 2014

(65) Prior Publication Data

US 2015/0259774 A1 Sep. 17, 2015

(51) Int. Cl.

| | |
|---|---|
| ***C22F 1/053*** | (2006.01) |
| ***C22C 21/10*** | (2006.01) |
| *C22F 1/00* | (2006.01) |

(52) U.S. Cl.

CPC ..... *C22F 1/053* (2013.01); *C22C 21/10* (2013.01); *C22F 1/002* (2013.01)

(58) Field of Classification Search

CPC ..... C22F 1/053; C22F 1/002; C22C 21/10
See application file for complete search history.

(56) References Cited

U.S. PATENT DOCUMENTS

| | | | | |
|---|---|---|---|---|
| 3,305,410 | A | 2/1967 | Sublett et al. | |
| 3,856,584 | A | 12/1974 | Cina | |
| 3,881,966 | A | 5/1975 | Staley et al. | |
| 4,477,292 | A | 10/1984 | Brown | |
| 4,863,528 | A | 9/1989 | Brown et al. | |
| 6,048,415 | A | 4/2000 | Nakai et al. | |
| 7,625,454 | B2 | 12/2009 | Lin et al. | |
| 9,249,487 | B2 * | 2/2016 | Yan | C22F 1/053 |
| 2003/0213537 | A1 | 11/2003 | Cho | |
| 2004/0099352 | A1 * | 5/2004 | Gheorghe | C22F 1/053 148/550 |

(Continued)

FOREIGN PATENT DOCUMENTS

WO WO 95-24514 9/1995

OTHER PUBLICATIONS

Ashton, R. F. et al., "Effect of Heating Rate on the Ageing Behavior of 7075 Alloy", *Transactions of the Metallurgical society of AIME*, 2102 vol. 245, Sep. 1969.

(Continued)

*Primary Examiner* — Veronica F Faison
(74) *Attorney, Agent, or Firm* — Greenberg Traurig, LLP

(57) ABSTRACT

New methods for aging aluminum alloys having zinc and magnesium are disclosed. The methods may include first aging the aluminum alloy at a first temperature of from about 310° F. to 530° F. and for a first aging time of from 1 minute to 6 hours, and then second aging the aluminum alloy at a second temperature for a second aging time of at least 30 minutes, with the second temperature being lower than the first temperature.

33 Claims, 1 Drawing Sheet

(56) References Cited

U.S. PATENT DOCUMENTS

| | | | | |
|---|---|---|---|---|
| 2006/0076093 | A1* | 4/2006 | Bennon | C22F 1/04 148/698 |
| 2006/0289093 | A1 | 12/2006 | Yan et al. | |
| 2008/0066833 | A1 | 3/2008 | Lin et al. | |
| 2008/0173378 | A1 | 7/2008 | Khosla et al. | |
| 2009/0269608 | A1 | 10/2009 | Benedictus et al. | |
| 2010/0180992 | A1* | 7/2010 | Giummarra | C22C 21/00 148/698 |

OTHER PUBLICATIONS

Hatch, J. E., "Aluminum Properties and Physical Metallurgy, American Society for Metals", pp. 145-148 and 177-191, 1984.

Islam, M.U., "Retrogression and Reaging Response of 7475 Aluminum, Alloy", *Metals Technology* vol. 10, pp. 386-392, Oct. 1983.

Wallace, W., "A New Approach to the Problem of Stress Corrosion Cracking in 7075-T6 Aluminum", *Canadian Aeronautics and Space Journal*, vol. 27 No. 3, pp. 222-232, 1981.

International Search Report and Written Opinion, dated Jul. 7, 2014, from corresponding, co-owned International Patent App. No. PCT/US2014/024576.

* cited by examiner

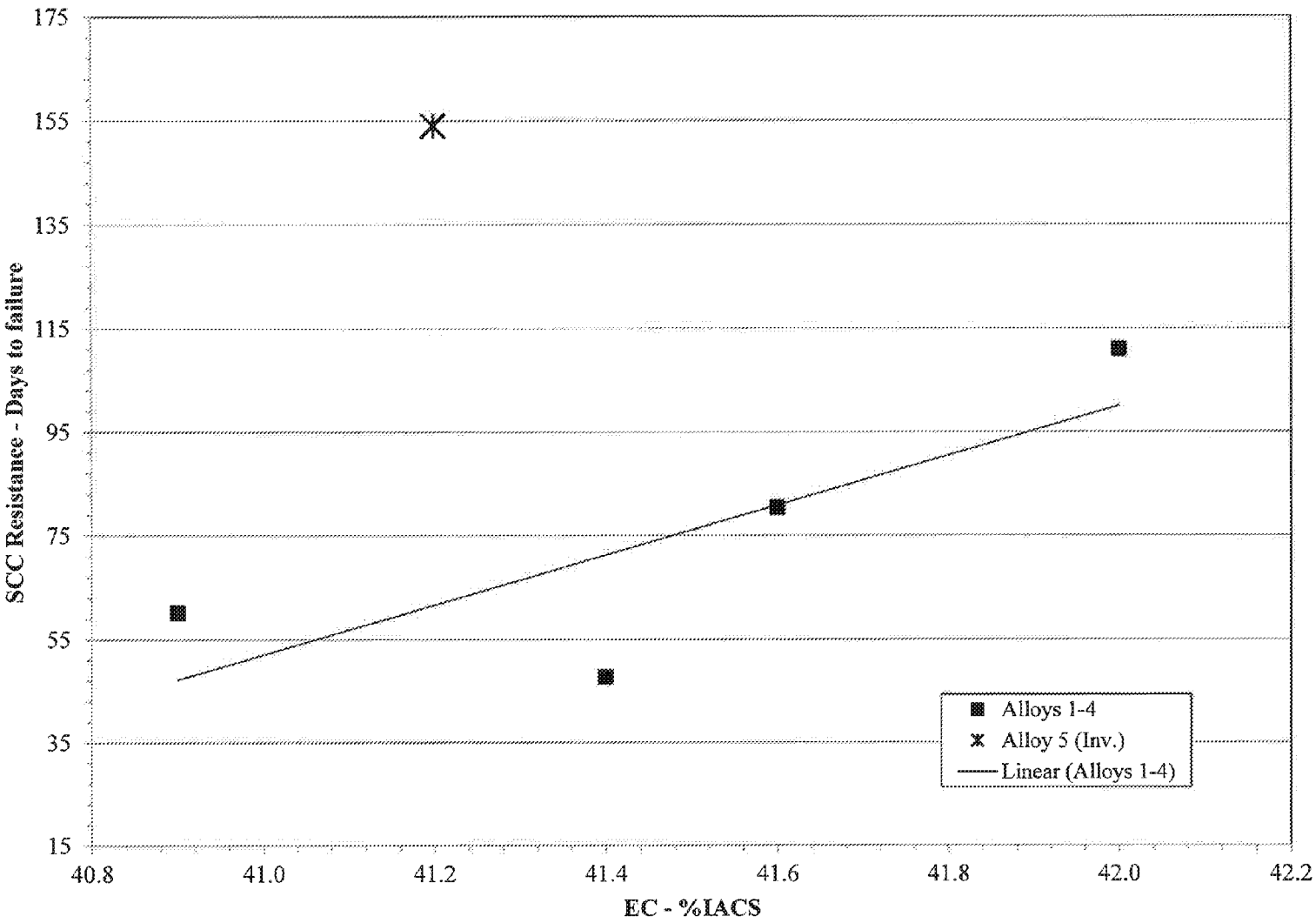
SCC Resistance - Days to failure
175
155
135
115
95
75
55
35
15
40.8
41.0
41.2
41.4
41.6
41.8
42.0
42.2
EC - %IACS
Alloys 1-4
Alloy 5 (Inv.)
Linear (Alloys 1-4)

METHODS FOR ARTIFICIALLY AGING ALUMINUM-ZINC-MAGNESIUM ALLOYS, AND PRODUCTS BASED ON THE SAME

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue crack growth resistance, to name two.

SUMMARY OF THE DISCLOSURE

Broadly, the present patent application relates to improved methods of artificially aging aluminum alloys having zinc and magnesium, and products based on the same. As used herein, aluminum alloys having zinc and magnesium are aluminum alloys where at least one of the zinc and the magnesium is the predominate alloying ingredient other than aluminum, and whether such aluminum alloys are casting alloys (i.e., 5xx.x or 7xx.x alloys) or wrought alloys (i.e., 5xxx or 7xxx alloy). The aluminum alloys having zinc generally comprise from 2.5 to 12 wt. % Zn, from 1.0 to 5.0 wt. % Mg and may include up to 3.0 wt. % Cu. In one embodiment, the aluminum alloy comprises 4.0-5.0 wt. % Zn and 1.0-2.5 wt. % Mg.

The method generally includes:

(a) casting an aluminum alloy having from 2.5-12 wt. % Zn and from 1.0 to 5.0 wt. % Mg, then;

(b) optionally hot working or cold working the aluminum alloy, (c) after the casting step (a) and the optional step (b), solution heat treating and then quenching the aluminum alloy;

(d) after step (c), optionally working the aluminum alloy; and (e) after step (c) and the optional step (d), artificially aging the aluminum alloy, wherein the artificial aging step (e) comprises:

(i) first aging the aluminum alloy at a first temperature of from about 310° F. (or about 330° F.) to 530° F. and for a first aging time of from 1 minute to 6 hours;

(ii) second aging the aluminum alloy at a second temperature for a second aging time of at least 30 minutes, wherein the second temperature is lower than the first temperature.

The methods may realize an improved combination of properties and/or improved throughput relative to conventional aging processes.

The casting step (a) may be any suitable casting step for a wrought aluminum alloy or a casting aluminum alloy. Wrought aluminum alloys may be cast, for example, by direct chill casting and/or continuous casting (e.g., via twin belt casting), among other methods. Casting aluminum alloys are shape cast, and may be cast via any suitable shape casting method, including permanent mold casting, high pressure die casting, sand mold casting, investment casting, squeeze casting and semi-solid casting, among others.

After the casting step (a), the method may include (b) optionally hot working and/or cold working the cast aluminum alloy. When the aluminum alloy is a wrought aluminum alloy, it is generally hot worked and may be cold worked after the casting step. This optional hot working step may include rolling, extruding and/or forging. The optional cold working step may include flow-forming, drawing and other cold working techniques. This optional step (b) is not completed when the aluminum alloy is a shape cast aluminum alloy. A homogenization step may occur before any hot working step (e.g., for wrought aluminum alloys).

After the optional hot working and/or cold working step (b), the method includes (c) solution heat treating and then quenching the aluminum alloy. Solution heat treating and then quenching, and the like, means heating an aluminum alloy to a suitable temperature, generally above the solvus temperature, holding at that temperature long enough to allow soluble elements to enter into solid solution, and cooling rapidly enough to hold the elements in solid solution. The solution heat treating may include placing the aluminum alloy in a suitable heating apparatus for a suitable period of time. The quenching (cooling) may be accomplished in any suitable manner, and via any suitable cooling medium. In one embodiment, the quenching comprises contacting the aluminum alloy with a gas (e.g., air cooling). In another embodiment, the quenching comprises contacting the aluminum alloy sheet with a liquid. In one embodiment, the liquid is aqueous based, such as water or another aqueous based cooling solution. In one embodiment, the liquid is water and the water temperature is at about ambient temperature. In another embodiment, the liquid is water, and the water temperature is at about boiling temperature. In another embodiment, the liquid is an oil. In one embodiment, the oil is hydrocarbon based. In another embodiment, the oil is silicone based.

After the solution heat treating and then quenching the aluminum alloy step (c), the method may optionally include (d) working the aluminum alloy body, such as by stretching 1-10% (e.g., for flatness and/or stress relief) and/or inducing a high amount of cold work (e.g., 25-90%), as taught by commonly-owned U.S. Patent Application Publication No. 2012/0055888. This optional step (d) may include hot working and/or cold working.

After the solution heat treating and then quenching the aluminum alloy step (c) and the optional working step (d), the method includes artificially aging the aluminum alloy (e). The artificial aging step (e) may include (i) first aging the aluminum alloy at a first temperature of from about 330° F. to 530° F. and for a first aging time of from 1 minute to 6 hours, and (ii) second aging the aluminum alloy at a second temperature for a second aging time of at least 30 minutes, wherein the second temperature is lower than the first temperature. One or more additional aging steps after the first and second aging steps may be completed. No artificial aging steps before the first aging step are completed.

As noted above, the first aging step generally occurs at a first aging temperature and this first aging temperature is generally from 310° F. (or 330° F.) to 530° F. Lower temperatures may be more useful with higher levels of zinc, and higher temperatures may be more useful with lower levels of zinc. In one embodiment, the first aging temperature is at least 350° F. In another embodiment, the first aging temperature is at least 370° F. In yet another embodiment, the first aging temperature is at least 390° F. In one embodiment, the first aging temperature is not greater than 460° F. In one embodiment, the first aging temperature is not greater than 420° F.

The duration of the first aging step is generally from 1 minute to 6 hours, and may be related to the first aging temperature. For example, longer first aging steps may be useful at lower temperatures, and shorter first aging steps may be useful at higher temperatures. In one embodiment, the first aging time is not greater than 2 hours. In another embodiment, the first aging time is not greater than 1 hour. In yet another embodiment, the first aging time is not greater than 45 minutes. In another embodiment, the first aging time is not greater than 30 minutes. In yet another embodiment, the first aging time is not greater than 20 minutes. In one embodiment, the first aging time may be at least 5 minutes.

In one embodiment, the first aging step is conducted for "1 to 30 minutes at a temperature of about 400° F.", or a substantially equivalent aging condition. As appreciated by those skilled in the art, aging temperatures and/or times may be adjusted based on well-known aging principles and/or formulas (e.g., using Fick's law). Thus, those skilled in the art could increase the aging temperature but decrease the aging time, or vice-versa, or only slightly change only one of these parameters, and still achieve the same result as "1 to 30 minutes of aging at a temperature of about 400° F.". The amount of artificial aging practices that could achieve the same result as "1 to 30 minutes of aging at a temperature of about 400° F." is numerous, and therefore all such substitute aging practices are not listed herein, even though they are within the scope of the present invention. The phrases "or a substantially equivalent artificial aging temperature and duration" and "or a substantially equivalent practice" are used to capture all such substitute aging practices.

As noted above, the second aging step generally occurs at a second temperature for a second aging time of at least 30 minutes, and the second temperature is lower than the first temperature. In one embodiment, the second aging temperature is from 5 to 150° F. lower than the first aging temperature. In another embodiment, the second aging temperature is from 10 to 100° F. lower than the first aging temperature. In yet another embodiment, the second aging temperature is from 10 to 75° F. lower than the first aging temperature. In another embodiment, the second aging temperature is from 20 to 50° F. lower than the first aging temperature.

As noted above, the duration of the second aging step is at least 30 minutes. In one embodiment, the duration of the second aging step is at least 1 hour. In another embodiment, the duration of the second aging step is at least 2 hours. In yet another embodiment, the duration of the second aging step is at least 3 hours. In one embodiment, the duration of the second aging step is not greater than 30 hours. In another embodiment, the duration of the second aging step is not greater than 20 hours. In another embodiment, the duration of the second aging step is not greater than 12 hours. In another embodiment, the duration of the second aging step is not greater than 10 hours. In another embodiment, the duration of the second aging step is not greater than 8 hours.

In one embodiment, the second aging step is conducted for "2 to 8 hours at a temperature of about 360° F.", or a substantially equivalent aging condition. As appreciated by those skilled in the art, aging temperatures and/or times may be adjusted based on well-known aging principles and/or formulas. Thus, those skilled in the art could increase the aging temperature but decrease the aging time, or vice-versa, or only slightly change only one of these parameters, and still achieve the same result as "2 to 8 hours of aging at a temperature of about 360° F.". The amount of artificial aging practices that could achieve the same result as "2 to 8 hours of aging at a temperature of about 360° F." is numerous, and therefore all such substitute aging practices are not listed herein, even though they are within the scope of the present invention. The phrases "or a substantially equivalent artificial aging temperature and duration" and "or a substantially equivalent practice" are used to capture all such substitute aging practices.

The method may optionally include forming the aluminum alloy into a predetermined shaped product during or after the aging step (e). As used herein, a "predetermined shaped product" and the like means a product that is formed into a shape via a shape forming operation (e.g., drawing, ironing, warm forming, flow forming, shear forming, spin forming, doming, necking, flanging, threading, beading, bending, seaming, stamping, hydroforming, and curling, among others), and which shape is determined in advance of the shape forming operation (step). Examples of predetermined shaped products include automotive components (e.g., hoods, fenders, doors, roofs, and trunk lids, among others) and containers (e.g., food cans, bottles, among others), consumer electronic components (e.g., as laptops, cell phones, cameras, mobile music players, handheld devices, computers, televisions, among others), among other aluminum alloy products. In one embodiment, the predetermined shaped product is in its final product form after the forming step. The forming step utilized to produce "predetermined shaped products" may occur concomitant to or after the artificial aging step (e.g., concomitant to or after the first aging step, and/or before, after or concomitant to the second aging step).

In one embodiment, the forming step is completed concomitant to the aging step (e), and thus may occur at elevated temperature. Such elevated temperature forming steps are referred to herein as "warm forming" operations. In one embodiment, a warm forming operation occurs at a temperature of from 200° F. to 530° F. In another embodiment, a warm forming operation occurs at a temperature of from 250° F. to 450° F. Thus, in some embodiments, warm forming may be used to produce predetermined shaped products. Warm forming may facilitate production of defect-free predetermined shaped products. Defect-free means that the components are suitable for use as a commercial product, and thus may have little (insubstantial) or no cracks, wrinkles, Ludering, thinning and/or orange peel, to name a few. In other embodiments, room temperature forming may be used to produce defect-free predetermined shaped products.

In one approach, the method comprises (a) shape casting an aluminum alloy, wherein the aluminum alloy comprises 4.0-5.0 wt. % Zn and 1.0-2.5 wt. % Mg, then (b) solution heat treating and then quenching the aluminum alloy body, and then (c) artificially aging the aluminum alloy, wherein the artificial aging includes first aging the aluminum alloy at a first temperature of from about 390° F. to 420° F. and for a first aging time of from 1 minute to 60 minutes, and (ii) second aging the aluminum alloy at a second temperature for a second aging time of at least 30 minutes, wherein the second temperature is lower than the first temperature. In one embodiment of this approach, the second aging temperature is from 300 to 380° F., and the aging time is from 1 to 36 hours. In another embodiment, the second aging temperature is from 330 to 370° F., and the aging time is from 1 to 8 hours. One or more additional aging steps after the first and second aging steps may be completed. No aging steps before the first aging step are completed.

In one approach, the method comprises (a) shape casting an aluminum alloy, wherein the aluminum alloy is one of aluminum casting alloy 707.X, 712.X, 713.X or 771.X, and then (b) solution heat treating and then quenching the aluminum alloy body, and then (c) artificially aging the aluminum alloy, wherein the artificial aging includes first aging the aluminum alloy, such as using any of the first aging conditions described above, and (ii) second aging the aluminum alloy at a second temperature for a second aging time of at least 30 minutes, wherein the second temperature is lower than the first temperature. One or more additional aging steps after the first and second aging steps may be completed. No artificial aging steps before the first aging step are completed. Aluminum shape casting alloys 707.X, 712.X, 713.X or 771.X, are known casting alloys, and their compositions are defined in, for example, The Aluminum Association document "*Designation and Chemical Compositions Limits for Aluminum Alloys in the Form of Castings and Ingot*," April 2002, which is incorporated herein by reference in its entirety. As known, the "X" may be replaced with a "0", "1", etc., to define the specific casting alloy composition (known or future). In a general sense, for this document, the "0" generally refers to the composition of a shape cast product, whereas a "1" or "2" generally refers to a composition of an ingot. For instance, 707.0 includes 1.8-2.4 wt. % Mg for a shape cast product made from the 707 alloy, whereas 707.1 includes 1.9-2.4 wt. % Mg for an ingot made from the 707 alloy.

In one embodiment, the alloy is a wrought 7xxx aluminum alloy product, meaning that the alloy has been hot worked at some point after casting. Examples of wrought products include rolled products (sheet and plate), extrusions and forgings. In one embodiment, a method includes (a) preparing a wrought 7xxx aluminum alloy for solution heat treating, wherein the wrought 7xxx aluminum alloy comprises 4.0-9.5 wt. % Zn, from 1.2 to 3.0 wt. % Mg, and up to 2.6 wt. % Cu, (b) after step (a), solution heat treating and then quenching the wrought 7xxx aluminum alloy, and (c) after step (b), artificially aging the wrought 7xxx aluminum alloy, wherein the artificial aging step (c) comprises, (i) first aging the wrought 7xxx aluminum alloy at a first temperature in the range of from 310° F. to 430° F. for from 1 minute to 360 minutes, (ii) second aging the wrought 7xxx aluminum alloy at a second temperature for at least 0.5 hour, wherein the second temperature is lower than the first temperature. One or more additional aging steps after the first and second aging steps may be completed. No aging artificial steps before the first aging step are completed. In one embodiment, the artificial aging step consists of the first aging step and the second aging step (i.e., only two aging steps are used). The first and second artificial aging steps generally comprise heating or cooling to the stated temperature(s), as the case may be, and then holding for the stated amount of time. For instance, a first artificial aging step of "370° F. for 10 minutes" would include heating the aluminum alloy until it reaches the target temperature of 370° F., and then holding for 10 minutes within a tolerable and controllable temperature range centered around 370° F. ((e.g., +/−° 10 F., or +/−° 5 F., for instance). Age integration may be used to facilitate proper aging.

In one embodiment, the method includes stress-relieving the wrought 7xxx aluminum alloy, wherein the stress-relieving occurs after the solution heat treating and then quenching step (b) and prior to the artificial aging step (c). In one embodiment, the stress-relieving comprises at least one of stretching by 0.5 to 8% and compressing by 0.5 to 12%.

As noted above, the method includes artificially aging the wrought 7xxx aluminum alloy, wherein the artificial aging step (c) comprises, (i) first aging the wrought 7xxx aluminum alloy at a first temperature in the range of from 310° F. to 430° F. for from 1 minute to 360 minutes, (ii) second aging the wrought 7xxx aluminum alloy at a second temperature for at least 0.5 hour, wherein the second temperature is lower than the first temperature. In one embodiment, the second temperature is at least 10° F. lower than the first temperature. In another embodiment, the second temperature is at least 20° F. lower than the first temperature. In yet another embodiment, the second temperature is at least 30° F. lower than the first temperature. In another embodiment, the second temperature is at least 40° F. lower than the first temperature. In yet another embodiment, the second temperature is at least 50° F. lower than the first temperature. In another embodiment, the second temperature is at least 60° F. lower than the first temperature. In yet another embodiment, the second temperature is at least 70° F. lower than the first temperature. In one embodiment, the first aging step is not greater than 120 minutes. In another embodiment, the first aging step is not greater than 90 minutes. In yet another embodiment, the first aging step is not greater than 60 minutes. In another embodiment, the first aging step is not greater than 45 minutes. In yet another embodiment, the first aging step is not greater than 30 minutes. In another embodiment, the first aging step is not greater than 20 minutes. In one embodiment, the first aging step is at least 5 minutes. In another embodiment, the first aging step is at least 10 minutes. In one embodiment, the first aging step is for from 5 to 20 minutes. In one embodiment, the second aging step is for from 1 to 12 hours. In another embodiment, the second aging step is for from 2 to 8 hours. In yet another embodiment, the second aging step is for from 3 to 8 hours.

In one approach, the wrought 7xxx aluminum alloy includes 4.0-9.5 wt. % Zn, from 1.2 to 3.0 wt. % Mg, and from 1.0 to 2.6 wt. % Cu. In one embodiment associated with this approach, the first temperature is from 310° to 400° F., and the first aging step is not greater than 120 minutes. In another embodiment, the first temperature is from 320° to 390° F., and the first aging step is not greater than 90 minutes. In yet another embodiment, the first temperature is from 330° to 385° F., and wherein the first aging step is not greater than 60 minutes. In another embodiment, the first temperature is from 340° to 380° F., and the first aging step is not greater than 30 minutes. In one embodiment, the second aging temperature is from 250° to 350° F., and the second aging step is from 0.5 to 12 hours. In another embodiment, the second aging temperature is from 270° to 340° F., and the second aging step is from 1 to 12 hours. In yet another embodiment, the second aging temperature is from 280° to 335° F., and the second aging step is from 2 to 8 hours. In another embodiment, the second aging temperature is from 290° to 330° F., and wherein the second aging step is from 2 to 8 hours. In yet another embodiment, the second aging temperature is from 300° to 325° F., and wherein the second aging step is from 2 to 8 hours. In some of these embodiments, the second aging step is at least 3 hours. In some of these embodiments, the second aging step is at least 4 hours. In one embodiment, the wrought 7xxx aluminum alloy includes from 5.7-8.4 wt. % Zn, from 1.3 to 2.3 wt. % Mg, and from 1.3 to 2.6 wt. % Cu. In one embodiment, the wrought 7xxx aluminum alloy includes from 7.0 to 8.4 wt. % Zn. In one embodiment, the wrought 7xxx aluminum alloy is selected from the group consisting of 7×85, 7×55, 7×50, 7×40, 7×99, 7×65, 7×78, 7×36, 7×37, 7×49, and 7×75, among others, as defined by The Aluminum Association document "International Alloy Designations and Chemical Composition Limits for Wrought Aluminum and Wrought Aluminum Alloys" February 2009, and its corresponding Addendum of February 2014, collectively the "Teal Sheets", both of which are incorporated herein by reference in their entirety. As known, the "x" may be replaced with a "0", "1", etc., as appropriate, to define the specific wrought 7xxx aluminum alloy composition (known or future). For instance, 7040 includes 1.5-2.3 wt. % Cu, 1.7-2.4 wt. % Mg, and 5.7-6.7 wt. % Zn, whereas 7140 includes 1.3-2.3 wt. % Cu, 1.5-2.4 wt. % Mg, and 6.2-7.0 wt. % Zn, as shown by the Teal Sheets. In one embodiment, the wrought 7xxx aluminum alloy is a 7×85 alloy. In another embodiment, the wrought 7xxx aluminum alloy is a 7×55 alloy. In yet another embodiment, the wrought 7xxx aluminum alloy is a 7×40 alloy. In another embodiment, the 7xxx aluminum alloy is a 7×65 alloy. In another embodiment, the alloy is a 7×50 alloy. In yet another embodiment, the 7xxx aluminum alloy is a 7×75 alloy.

In another approach, the wrought 7xxx aluminum alloy includes 4.0-9.5 wt. % Zn, from 1.2 to 3.0 wt. % Mg, and from 0.25 to less than 1.0 wt. % Cu. In one embodiment associated with this approach, the first temperature is from 330° to 430° F., and the first aging step is not greater than 120 minutes. In another embodiment, the first temperature is from 340° to 425° F., and the first aging step is not greater than 90 minutes. In yet another embodiment, the first temperature is from 350° to 420° F., and the first aging step is not greater than 60 minutes. In another embodiment, the first temperature is from 360° to 415° F., and the first aging step is not greater than 30 minutes. In one embodiment, the second aging temperature is from 250° to 370° F., and the second aging step is from 0.5 to 12 hours. In another embodiment, the second aging temperature is from 270° to 360° F., and the second aging step is from 1 to 12 hours. In yet another embodiment, the second aging temperature is from 280° to 355° F., and the second aging step is from 2 to 8 hours. In another embodiment, the second aging temperature is from 290° to 350° F., and the second aging step is from 2 to 8 hours. In yet another embodiment, the second aging temperature is from 300° to 345° F., and the second aging step is from 2 to 8 hours. In some of these embodiments, the second aging step is at least 3 hours. In some of these embodiments, the second aging step is at least 4 hours. In one embodiment, the wrought 7xxx aluminum alloy is a 7×41 alloy, as defined by the Teal Sheets. In one embodiment, the wrought 7xxx aluminum alloy is Russian alloy RU1953.

In yet another approach, the wrought 7xxx aluminum alloy includes 4.0-9.5 wt. % Zn, from 1.2 to 3.0 wt. % Mg, and less than 0.25 wt. % Cu. In one embodiment associated with this approach, the first temperature is from 310° to 400° F., and the first aging step is not greater than 120 minutes. In another embodiment, the first temperature is from 320° to 390° F., and the first aging step is not greater than 90 minutes. In yet another embodiment, the first temperature is from 330° to 385° F., and the first aging step is not greater than 60 minutes. In another embodiment, the first temperature is from 340° to 380° F., and the first aging step is not greater than 30 minutes. In one embodiment, the second aging temperature is from 250° to 350° F., and the second aging step is from 0.5 to 12 hours. In another embodiment, the second aging temperature is from 270° to 340° F., and the second aging step is from 1 to 12 hours. In yet another embodiment, the second aging temperature is from 280° to 335° F., and the second aging step is from 2 to 8 hours. In another embodiment, the second aging temperature is from 290° to 330° F., and the second aging step is from 2 to 8 hours. In yet another embodiment, the second aging temperature is from 300° to 325° F., and the second aging step is from 2 to 8 hours. In some of these embodiments, the second aging step is at least 3 hours. In some of these embodiments, the second aging step is at least 4 hours. In one embodiment, the wrought 7xxx aluminum alloy is selected from the group consisting of 7×05, 7×39, and 7×47, as defined by the Teal Sheets, or Russian alloy RU1980. In one embodiment, the wrought 7xxx aluminum alloy is a 7×39 alloy. In one embodiment, the wrought 7xxx aluminum alloy is Russian alloy RU1980.

The new aluminum alloys having zinc and magnesium described herein may be used in a variety of applications, such as in automotive and/or aerospace applications, among others. In one embodiment, the new aluminum alloys are used in an aerospace application, such as wing skins (upper and lower) or stringers/stiffeners, fuselage skin or stringers, ribs, frames, spars, seat tracks, bulkheads, circumferential frames, empennage (such as horizontal and vertical stabilizers), floor beams, seat tracks, doors, and control surface components (e.g., rudders, ailerons) among others. In another embodiment, the new aluminum alloys are used in an automotive application, such as closure panels (e.g., hoods, fenders, doors, roofs, and trunk lids, among others), wheels, and critical strength applications, such as in body-in-white (e.g., pillars, reinforcements) applications, among others. In another embodiment, the new aluminum alloys are used in a munitions/ballistics/military application, such as in ammunition cartridges and armor, among others. Ammunition cartridges may include those used in small arms and cannons or for artillery or tank rounds. Other possible ammunition components would include sabots and fins. Artillery, fuse components are another possible application as are fins and control surfaces for precision guided bombs and missiles. Armor components could include armor plates or structural components for military vehicles. In another embodiment, the new aluminum alloys are used in an oil and gas application, such as for risers, auxiliary lines, drill pipe, choke-and-kill lines, production piping, and fall pipe, among others.

BRIEF DESCRIPTION OF THE DRAWINGS

FIG. 1 is a graph illustrating the electrical conductivity versus SCC performance for the Example 1 alloys.

DETAILED DESCRIPTION

EXAMPLE 1

A 7xx casting aluminum alloy having the composition shown in Table 1, below, was cast via directional solidification.

TABLE 1

| Composition of Ex. 1 Alloy (in wt. %) | | | |
|---|---|---|---|
| Alloy | Zn | Mg | Cu |
| 1 | 4.24 | 1.52 | 0.80 |

After casting, Alloy 1 was solution heat treated, and then quenched in boiling water. Alloy 1 was then stabilized by naturally aging for about 12-24 hours at room temperature. Next Alloy 1 was artificially aged at various times and temperatures, as shown in Table 2, below. For Alloys 1-A through 1-D, the alloys were heated from ambient to the first aging temperature in about 40 minutes, and then held at the first aging temperature for the stated duration; after the first aging step was completed, Alloys 1-A through 1-D were heated to the second aging temperature in about 45 minutes, and then held at the second aging temperature for the stated duration. Alloy 1-E was heated from ambient to the first aging temperature in about 50 minutes, and then held at the first aging temperature for the stated duration; after the first aging step was completed, power to the furnace was turnedoff and the furnace was open to the air until the furnace reached the second target temperature (about 10 minutes), and after which Alloy 1-E was held at the second aging temperature for the stated duration.

TABLE 2

Artificial Aging Practices

| Alloy | 1st Step | 2nd Step | Note |
|---|---|---|---|
| 1-A | 250° F. for 3 hours | 360° F. for 16 hours | Non-Invention |
| 1-B | 250° F. for 3 hours | 360° F. for 3 hours | Non-Invention |
| 1-C | 250° F. for 3 hours | 360° F. for 4 hours | Non-Invention |
| 1-D | 250° F. for 3 hours | 360° F. for 5 hours | Non-Invention |
| 1-E | 400° F. for 10 mins. | 360° F. for 4 hours | Invention |

Various mechanical properties and the SCC (stress corrosion cracking) resistance of the alloys were then measured, the results of which are shown in Tables 3-5, below. Strength and elongation were measured in accordance with ASTM E8 and B557 (average of triplicate specimens). Fatigue performance was tested in accordance with ASTM E466 (Kt=1, R=−1, Stress=23.2 ksi, 25 Hz, in lab air) (average of triplicate specimens). SCC resistance was measured in accordance with ASTM G103 (stress=34.8 ksi).

TABLE 3

Strength and Elongation Properties of Ex. 1 Alloys

| Alloy | TYS (ksi) | UTS (ksi) | Total El (%) |
|---|---|---|---|
| 1-A | 47.4 | 55.4 | 9.3 |
| 1-B | 49.9 | 56.5 | 6.7 |
| 1-C | 48.5 | 56.3 | 9.3 |
| 1-D | 47.4 | 53.9 | 6.3 |
| 1-E | 46.8 | 54.7 | 8.7 |

TABLE 4

Fatigue Properties of Ex. 1 Alloys

| Alloy | Average Cycles to Fail | Standard Deviation |
|---|---|---|
| 1-A | 105,421 | 27,715 |
| 1-B | 109,519 | 58,674 |
| 1-C | 142,187 | 105,362 |
| 1-D | 90,002 | 22,694 |
| 1-E | 144,611 | 35,256 |

TABLE 5

SCC resistance of Ex. 1 Alloys

| Alloy | Specimen | Hours to Failure | Average hours to Failure |
|---|---|---|---|
| 1-A | 1 | 45 | 111 |
| | 2 | 96 | |
| | 3 | 96 | |
| | 4 | 150 | |
| | 5 | 168 | |
| 1-B | 1 | 21 | 60.2 |
| | 2 | 45 | |
| | 3 | 45 | |
| | 4 | 72 | |
| | 5 | 118 | |
| 1-C | 1 | 24 | 47.8 |
| | 2 | 30 | |
| | 3 | 45 | |

TABLE 5-continued

SCC resistance of Ex. 1 Alloys

| Alloy | Specimen | Hours to Failure | Average hours to Failure |
|---|---|---|---|
| | 4 | 68 | |
| | 5 | 72 | |
| 1-D | 1 | 68 | 80.4 |
| | 2 | 72 | |
| | 3 | 72 | |
| | 4 | 72 | |
| | 5 | 118 | |
| 1-E | 1 | 142 | 154 |
| | 2 | 142 | |
| | 3 | 150 | |
| | 4 | 168 | |
| | 5 | 168 | |

As shown above, the invention alloy (1-E) achieves about the same strength but better fatigue resistance as compared to the non-invention alloys. The invention alloy also achieves much better stress corrosion cracking resistance as compared to the non-invention alloys. Furthermore, the invention alloy achieves its improved properties with only about 4 hours, 10 minutes of artificial aging time, whereas the non-invention alloys all required at least 6 or more hours of artificial aging time.

The electrical conductivity of the alloys was also measured using a HOCKing electric conductivity meter (Auto-Sigma 3000DL), the results of which are shown in Table 6, below (average of quadruplicate specimens). As shown in FIG. 1, the invention alloy unexpectedly achieves better SCC performance at lower electrical conductivity. The lower electrical conductivity of the invention alloy indicates that it has not been overly aged, but yet still improved SCC performance is achieved.

TABLE 6

Electrical conductivity of Ex. 1 Alloys

| Alloy | Average EC (% IACS) | Stdev |
|---|---|---|
| 1-A | 42.0 | 0.55 |
| 1-B | 40.9 | 0.15 |
| 1-C | 41.4 | 0.05 |
| 1-D | 41.6 | 0.01 |
| 1-E | 41.2 | 0.06 |

EXAMPLE 2

Alloy 1 from Example 1 was processed similar to Example 1, but was artificially aged for various times as shown in Table 7, below.

TABLE 7

Artificial Aging Practices

| Alloy | 1st Step | 2nd Step | Note |
|---|---|---|---|
| 1-F | 400° F. for 10 mins. | 360° F. for 3 hours | Invention |
| 1-G | 400° F. for 10 mins. | 360° F. for 4 hours | Invention |
| 1-H | 400° F. for 10 mins. | 360° F. for 6 hours | Invention |
| 1-I | 400° F. for 5 mins. | 360° F. for 4 hours | Invention |
| 1-J | 400° F. for 20 mins. | 360° F. for 4 hours | Invention |

Various mechanical properties and the SCC (stress corrosion cracking) resistance of the alloys were then measured, the results of which are shown in Tables 8-10, below. Strength and elongation were measured in accordance with ASTM E8 and B557 (average of triplicate specimens). Fatigue performance was tested in accordance with ASTM E466 (Kt=1, R=−1, Stress=23.2 ksi, 25 Hz, in lab air) (average of triplicate specimens). SCC resistance was measured in accordance with ASTM G103 (stress=34.8 ksi).

TABLE 8

Strength and Elongation Properties of Ex. 2 Alloys

| Alloy | TYS (ksi) | UTS (ksi) | Total El (%) |
|---|---|---|---|
| 1-F | 48.7 | 55.5 | 7.3 |
| 1-G | 48.0 | 55.1 | 7.3 |
| 1-H | 48.0 | 54.7 | 7.0 |
| 1-I | 46.9 | 53.6 | 6.3 |
| 1-J | 47.5 | 54.5 | 8.0 |

TABLE 9

Fatigue Properties of Ex. 2 Alloys

| Alloy | Average Cycles to Fail | Standard Deviation |
|---|---|---|
| 1-F | 112,269 | 48,630 |
| 1-G | 144,611 | 35,256 |
| 1-H | 94,599 | 49,852 |
| 1-I | 103,367 | 31,106 |
| 1-J | 107,605 | 16,369 |

TABLE 10

SCC resistance of Ex. 2 Alloys

| Alloy | Specimen | Hours to Failure | Average hours to Failure |
|---|---|---|---|
| 1-F | 1 | 72 | 102.3 |
| | 2 | 72 | |
| | 3 | 96 | |
| | 4 | 124.08 | |
| | 5 | 147.6 | |
| 1-G | 1 | 96 | 142.8 |
| | 2 | 113.76 | |
| | 3 | 168 | |
| | 4 | 168 | |
| | 5 | 168 | |
| 1-H | 1 | 96 | 124.8 |
| | 2 | 96 | |
| | 3 | 96 | |
| | 4 | 168 | |
| | 5 | 168 | |
| 1-I | 1 | 42 | 118.8 |
| | 2 | 96 | |
| | 3 | 120 | |
| | 4 | 168 | |
| | 5 | 168 | |
| 1-J | 1 | 96 | 138.0 |
| | 2 | 114 | |
| | 3 | 144 | |
| | 4 | 168 | |
| | 5 | 168 | |

Similar to Example 1, the invention alloys achieve a good combination of strength, fatigue resistance and stress corrosion cracking resistance.

EXAMPLE 3

Alloy 1 from Example 1 was processed similar to Example 1, but was artificially aged for various times as shown in Table 11, below.

TABLE 11

Artificial Aging Practices

| Alloy | 1st Step | 2nd Step | Note |
|---|---|---|---|
| 1-K | 390° F. for 10 mins. | 360° F. for 4 hours | Invention |
| 1-L | 400° F. for 10 mins. | 360° F. for 4 hours | Invention |
| 1-M | 420° F. for 10 mins. | 360° F. for 4 hours | Invention |

Various mechanical properties and the SCC (stress corrosion cracking) resistance of the alloys were then measured, the results of which are shown in Tables 12-14, below. Strength and elongation were measured in accordance with ASTM E8 and B557 (average of triplicate specimens, except Alloy 1-K, which was the average of duplicate specimens). Fatigue performance was tested in accordance with ASTM E466 (Kt=1, R=−1, Stress=23.2 ksi, 25 Hz, in lab air) (average of triplicate specimens). SCC resistance was measured in accordance with ASTM G103 (stress=34.8 ksi).

TABLE 12

Strength and Elongation Properties of Ex. 3 Alloys

| Alloy | TYS (ksi) | UTS (ksi) | Total El (%) |
|---|---|---|---|
| 1-K | 48.2 | 53.6 | 5.5 |
| 1-L | 48.0 | 54.1 | 5.7 |
| 1-M | 46.9 | 52.6 | 5.3 |

TABLE 13

Fatigue Properties of Ex. 3 Alloys

| Alloy | Average Cycles to Fail | Standard Deviation |
|---|---|---|
| 1-K | 110423 | 41955 |
| 1-L | 110362 | 36083 |
| 1-M | 103406 | 23128 |

TABLE 14

SCC resistance of Ex. 3 Alloys

| Alloy | Specimen | Hours to Failure | Average hours to Failure |
|---|---|---|---|
| 1-K | 1 | 46 | 104 |
| | 2 | 94 | |
| | 3 | 94 | |
| | 4 | 118 | |
| | 5 | 168 | |
| 1-L | 1 | 48 | 117.4 |
| | 2 | 79 | |
| | 3 | 146 | |
| | 4 | 146 | |
| | 5 | 168 | |
| 1-M | 1 | 94 | 153.2 |
| | 2 | 168 | |
| | 3 | 168 | |
| | 4 | 168 | |
| | 5 | 168 | |

Similar to Examples 1-2, the invention alloys achieve a good combination of strength, fatigue resistance and stress corrosion cracking resistance.

EXAMPLE 4

Aging of Wrought Aluminum Alloy 7085

Aluminum alloy 7085 having the composition shown in Table 15 was produced as a conventional plate product (e.g., homogenized, rolled to final gauge, solution heat treated and cold water quenched, stress relieved by stretching (2%)) having a thickness of 2 inches. After about four days of natural aging, the 7085 plate was multi-step aged for various times at various temperatures, as shown in Table 16. After aging, mechanical properties were measured in accordance with ASTM E8 and B557, the results of which are shown in Table 17. Stress corrosion cracking (SCC) resistance was also measured in accordance with ASTM G44, 3.5% NaCl, Alternate Immersion, the results of which are shown in Table 18 (stress in the ST direction).

TABLE 15

Composition of the 7085 Alloy (in wt. %)*

| Alloy | Zn | Mg | Cu | Zr | Si | Fe | Mn | Cr | Ti |
|---|---|---|---|---|---|---|---|---|---|
| 7085 | 7.39 | 1.54 | 1.66 | 0.11 | 0.02 | 0.03 | <0.01 | <0.01 | 0.02 |

*The balance of the alloy is aluminum and other elements, with the aluminum alloy containing not more than 0.05 wt. % each of any other element, and with the aluminum alloy containing not more than 0.15 wt. % in total of the other elements.

TABLE 16

Artificial Aging Practices

| Alloy | 1st Step | 2nd Step |
|---|---|---|
| 7085-1 | N/A - Conventional 3-step aging practice of 250° F. for 6 hours, then 310° F. for 18 hours, and then 250° F. for 24 hours | |
| 7085-2 | 400° F. for 10 mins. | 310° F. for 4 hour |
| 7085-3 | 400° F. for 10 mins. | 310° F. for 6 hours |
| 7085-4 | 400° F. for 10 mins. | 310° F. for 8 hours |
| 7085-5 | 460° F. for 5 mins. | 310° F. for 8 hours |
| 7085-6 | 430° F. for 7.5 mins. | 310° F. for 8 hours |
| 7085-7 | 400° F. for 5 mins. | 310° F. for 8 hours |
| 7085-8 | 400° F. for 15 mins. | 310° F. for 8 hours |
| 7085-9 | 460° F. for 5 mins. | 310° F. for 4 hours |
| 7085-10 | 460° F. for 5 mins. | 310° F. for 6 hours |
| 7085-11 | 375° F. for 10 mins. | 310° F. for 4 hours |
| 7085-12 | 375° F. for 20 mins. | 310° F. for 4 hours |
| 7085-13 | 375° F. for 30 mins. | 310° F. for 4 hours |
| 7085-14 | 345° F. for 15 mins. | 310° F. for 6 hours |
| 7085-15 | 345° F. for 30 mins. | 310° F. for 6 hours |
| 7085-16 | 345° F. for 72 mins. | 310° F. for 6 hours |
| 7085-17 | 345° F. for 90 mins. | 310° F. for 6 hours |
| 7085-18 | 345° F. for 72 mins. | 310° F. for 4 hours |

For the artificial aging, the samples were heated to the first temperature in about 50 minutes and then held at the stated temperature for the stated amount of time. The samples were then cooled to the second temperature by changing the furnace set-point and opening the furnace door until the second temperature was reached. The specimens were then held at the second temperature for the stated amount of time, after which the samples were removed from the furnace and allowed to air cool to room temperature.

TABLE 17

Mechanical Properties

| Alloy | Tensile Yield Strength (TYS), ksi (ST) | Ultimate Tensile Strength (UTS), ksi (ST) | Elongation, % (ST) |
|---|---|---|---|
| 7085-1 | 67.7 | 76.3 | 10.9 |
| 7085-2 | 61.3 | 70.8 | 10.9 |
| 7085-3 | 60.3 | 70.5 | 10.9 |
| 7085-4 | 61.2 | 71.3 | 11.4 |
| 7085-5 | 46.1 | 59.1 | 14.1 |
| 7085-6 | 51.8 | 63.7 | 14.1 |
| 7085-7 | 60.5 | 70.5 | 11.4 |
| 7085-8 | 57.8 | 68.4 | 10.4 |
| 7085-9 | 46.9 | 59.8 | 15.1 |
| 7085-10 | 46.3 | 59.1 | 14.6 |
| 7085-11 | 65.5 | 74.2 | 12.0 |
| 7085-12 | 65.2 | 73.8 | 10.9 |
| 7085-13 | 64.2 | 73.0 | 10.9 |
| 7085-14 | 67.3 | 75.5 | 9.4 |
| 7085-15 | 66.2 | 74.6 | 10.4 |
| 7085-16 | 65.5 | 74.4 | 9.9 |
| 7085-17 | 65.5 | 74.3 | 9.4 |
| 7085-18 | 66.2 | 74.8 | 9.4 |

TABLE 18

SCC Results

| | | Days to Failure | | | | |
|---|---|---|---|---|---|---|
| Alloy | Stress (ksi) | Specimen 1 | Specimen 2 | Specimen 3 | Specimen 4 | Specimen 5 |
| 7085-1 | 45 | DNF | 50 | 42 | 86 | 89 |
| 7085-1 | 55 | DNF | 89 | 44 | 33 | 29 |
| 7085-2 | 45 | DNF | DNF | DNF | DNF | N/A |
| 7085-2 | 55 | DNF | DNF | 90 | DNF | N/A |
| 7085-3 | 45 | DNF | DNF | DNF | 77 | N/A |
| 7085-3 | 55 | DNF | DNF | DNF | DNF | N/A |
| 7085-4 | 45 | DNF | DNF | DNF | DNF | N/A |
| 7085-4 | 55 | DNF | DNF | DNF | DNF | N/A |
| 7085-5 | 45 | DNF | DNF | DNF | DNF | N/A |
| 7085-5 | 55 | DNF | DNF | DNF | DNF | N/A |
| 7085-6 | 45 | DNF | DNF | DNF | DNF | N/A |
| 7085-6 | 55 | DNF | DNF | DNF | DNF | N/A |
| 7085-7 | 45 | DNF | DNF | DNF | DNF | N/A |
| 7085-7 | 55 | DNF | DNF | DNF | DNF | N/A |
| 7085-8 | 45 | DNF | DNF | DNF | DNF | N/A |
| 7085-8 | 55 | DNF | DNF | DNF | DNF | N/A |
| 7085-9 | 45 | DNF | DNF | DNF | DNF | N/A |
| 7085-9 | 55 | DNF | DNF | DNF | DNF | N/A |
| 7085-10 | 45 | DNF | DNF | DNF | DNF | N/A |
| 7085-10 | 55 | DNF | DNF | DNF | DNF | N/A |
| 7085-11 | 45 | DNF (66) | 51 | 59 | 50 | N/A |
| 7085-11 | 55 | DNF (66) | DNF (66) | 43 | DNF (66) | N/A |
| 7085-14 | 45 | 50 | 50 | 59 | 40 | N/A |
| 7085-14 | 55 | 40 | DNF (66) | 44 | 44 | 43 |
| 7085-12 | 55 | DNF (66) | 58 | DNF (66) | 48 | 54 |
| 7085-13 | 55 | 58 | 57 | DNF (66) | DNF (66) | 65 |
| 7085-15 | 55 | 54 | 47 | DNF (66) | DNF (66) | DNF (66) |
| 7085-16 | 55 | 64 | DNF (66) | DNF (66) | 64 | DNF (66) |
| 7085-17 | 55 | 64 | DNF (66) | 62 | DNF (66) | DNF (66) |
| 7085-18 | 55 | DNF (66) | 54 | DNF (66) | 52 | 59 |

* DNF = did not fail after 90 days
** DNF(66) = did not fail after 66 days

As shown, the new aging practice yields significant improvement in throughput via decreased total aging time, and with similar strength and corrosion resistance. Indeed, alloy 7085-14 realizes about the same strength as conventionally aged 7085-1, but with only 6.25 hours of total aging time (not including ramp-up time and cool down time) as compared to the total aging time of 48 hours (not including ramp-up time and cool down time) for alloy 7085-1.

EXAMPLE 5

Aging of Alloy 7255

Aluminum alloy 7255 having the composition shown in Table 19 was produced as a conventional plate product (e.g., homogenized, rolled to final gauge, solution heat treated and cold water quenched, stress relieved by stretching (2%)) having a thickness of 1.5 inches. After about four days of natural aging, the 7255 plate was multi-step aged for various times at various temperatures, as shown in Table 20. After aging, mechanical properties were measured in accordance with ASTM E8 and B557, the results of which are shown in Table 21. Stress corrosion cracking (SCC) resistance was also measured in accordance with ASTM G44, 3.5% NaCl, Alternate Immersion, the results of which are shown in Table 22 (stress in the ST direction and with a stress of 35 ksi). For some of the alloys, electrical conductivity (% IACS) was measured in accordance with ASTM E1004-09, Standard Test Method for Determining Electrical Conductivity Using the Electromagnetic (Eddy-Current) Method, using a 1 inch by 1.5 inch by 4 inch block, the results of which are shown in Table 23, below.

TABLE 19

Composition of the 7255 Alloy (in wt. %)*

| Alloy | Zn | Mg | Cu | Zr | Si | Fe | Mn | Cr | Ti |
|---|---|---|---|---|---|---|---|---|---|
| 7255 | 7.98 | 1.91 | 2.18 | 0.11 | 0.02 | 0.03 | <0.01 | <0.01 | 0.02 |

*The balance of the alloy is aluminum and other elements, with the aluminum alloy containing not more than 0.05 wt. % each of any other element, and with the aluminum alloy containing not more than 0.15 wt. % in total of the other elements.

TABLE 20

Artificial Aging Practices

| Alloy | 1st Step | 2nd Step |
|---|---|---|
| 7255-1 | N/A - Conventional 3-step aging practice of 250° F. for 6 hours, then 400° F. for 3 minutes (≈30 minute ramp to 400° F.), and then 250° F. for 24 hours | |
| 7255-2 | 400° F. for 10 mins. | 310° F. for 4 hours |
| 7255-3 | 400° F. for 10 mins. | 310° F. for 6 hours |
| 7255-4 | 400° F. for 10 mins. | 310° F. for 8 hours |
| 7255-5 | 480° F. for 5 mins. | 310° F. for 8 hours |
| 7255-6 | 440° F. for 10 mins. | 310° F. for 8 hours |
| 7255-7 | 400° F. for 5 mins. | 310° F. for 8 hours |
| 7255-8 | 400° F. for 15 mins. | 310° F. for 8 hours |
| 7255-9 | 480° F. for 5 mins. | 310° F. for 4 hours |
| 7255-10 | 480° F. for 5 mins. | 310° F. for 6 hours |
| 7255-11 | 370° F. for 5 mins. | 310° F. for 4 hours |
| 7255-12 | 370° F. for 10 mins. | 310° F. for 4 hours |
| 7255-13 | 370° F. for 20 mins. | 310° F. for 4 hours |
| 7255-14 | 345° F. for 15 mins. | 310° F. for 4 hours |
| 7255-15 | 345° F. for 30 mins. | 310° F. for 4 hours |
| 7255-16 | 345° F. for 60 mins. | 310° F. for 4 hours |
| 7255-17 | 370° F. for 10 mins. | N/A |

For the artificial aging, unless otherwise stated, the samples were heated to the first temperature in about 50 minutes and then held at the stated temperature for the stated amount of time. The samples were then cooled to the second temperature by changing the furnace set-point and opening the furnace door until the second temperature was reached. The specimens were then held at the second temperature for the stated amount of time, after which the samples were removed from the furnace and allowed to air cool to room temperature.

TABLE 21

Mechanical Properties

| Alloy | Tensile Yield Strength (TYS), ksi (ST) | Ultimate Tensile Strength (UTS), ksi (ST) | Elongation, % |
|---|---|---|---|
| 7255-1 | 77.9 | 88.9 | 4.7 |
| 7255-2 | 68.8 | 79.6 | 9.4 |
| 7255-3 | 67.7 | 78.7 | 9.4 |
| 7255-4 | 67.6 | 79.0 | 9.4 |
| 7255-5 | 44.0 | 59.3 | 13.6 |
| 7255-6 | 54.2 | 68.3 | 12.5 |
| 7255-7 | 70.0 | 81.2 | 7.8 |
| 7255-8 | 65.0 | 76.9 | 9.4 |
| 7255-9 | 43.5 | 59.1 | 12.5 |
| 7255-10 | 43.8 | 59.5 | 12.5 |
| 7255-11 | 75.7 | 85.8 | 7.8 |
| 7255-12 | 75.1 | 84.4 | 6.7 |
| 7255-13 | 75.2 | 84.4 | 5.7 |
| 7255-14 | 76.1 | 85.3 | 6.2 |
| 7255-15 | 75.8 | 85.0 | 6.2 |
| 7255-16 | 75.5 | 84.3 | 5.7 |
| 7255-17 | 74.6 | 84.9 | 6.2 |

TABLE 22

SCC Results

| | Days to Failure | | | | |
|---|---|---|---|---|---|
| Alloy | Specimen 1 | Specimen 2 | Specimen 3 | Specimen 4 | Specimen 5 |
| 7255-1 | 5 | 71 | 6 | 8 | 5 |
| 7255-2 | 88 | 42 | 88 | 74 | 43 |
| 7255-3 | 63 | 70 | 74 | 54 | 53 |
| 7255-4 | 49 | 88 | 88 | 88 | 88 |
| 7255-5 | DNF | DNF | DNF | DNF | DNF |
| 7255-6 | DNF | DNF | DNF | DNF | DNF |
| 7255-7 | 60 | 63 | 88 | 47 | 46 |
| 7255-8 | 88 | 71 | DNF | 90 | 90 |
| 7255-9 | DNF | DNF | DNF | DNF | DNF |
| 7255-10 | DNF | DNF | DNF | DNF | DNF |
| 7255-11 | 48 | 32 | 26 | 25 | 22 |
| 7255-12 | 45 | 41 | 51 | 52 | 52 |
| 7255-13 | 51 | DNF(66) | 53 | 53 | 57 |
| 7255-14 | 8 | 8 | 8 | 32 | 24 |
| 7255-15 | 24 | 43 | 48 | 8 | 32 |
| 7255-16 | 53 | 32 | 47 | 41 | DNF(66) |
| 7255-17 | 8 | 8 | 8 | 8 | 8 |

* DNF = did not fail after 90 days
** DNF(66) = did not fail after 66 days

As shown, the new aging practice yields significant improvement in throughput via decreased total aging time, and with similar strength and corrosion resistance. Indeed, alloy 7255-14 realizes about the same strength as conventionally aged 7255-1, but with only 4.25 hours of total aging time (not including ramp-up time and cool down time) as compared to the total aging time of about 30 hours (not including ramp-up time and cool down time) for alloy 7255-1. The 7255-14 alloy also realizes comparable corrosion resistance to alloy 7255-1. Improved corrosion resistance is realized by alloys 7255-15 and 7255-16 over alloy 7255-1, with comparable strength, and with only 4.5-5.0 hours of total aging time (not including ramp-up time and cool down time).

TABLE 23

| Electrical Conductivity + SCC Results | | |
|---|---|---|
| Alloy | Ave. SCC (days to failure) | EC (% IACS) |
| 7255-1 | 19 | 37.5 |
| 7255-11 | 30.6 | 37.2 |
| 7255-12 | 48.2 | 37.6 |
| 7255-13 | 56 | 38.8 |
| 7255-14 | 16 | 37.0 |
| 7255-15 | 31 | 37.1 |
| 7255-16 | 47.8 | 38.5 |
| 7255-17 | 8 | 36.2 |

EXAMPLE 6

Aging of Alloy 1980

Russian alloy 1980 having the composition shown in Table 24 was produced as a conventional rod product (e.g., homogenized, extruded to rod, solution heat treated and cold water quenched) having an outer diameter of about 7.0 inches and a thickness of about 1.3 inches. After about 0.5-1 days of natural aging, the 1980 alloy rod was multi-step aged for various times at various temperatures, as shown in Table 25. After aging, mechanical properties were measured in accordance with ASTM E8 and B557, the results of which are shown in Table 26. Stress corrosion cracking (SCC) resistance for some of the alloys was also measured in accordance with ASTM G103, Boiling Salt Test, the results of which are shown in Table 27 (stress in the ST direction and with a stress of 16.2 ksi).

TABLE 24

| Composition of the 1980 Alloy (in wt. %)* | | | | | | | | | |
|---|---|---|---|---|---|---|---|---|---|
| Alloy | Zn | Mg | Cu | Zr | Si | Fe | Mn | Cr | Ti |
| 1980 | 4.25 | 2.00 | 0.07 | 0.12 | 0.12 | 0.20 | 0.38 | 0.13 | <0.01 |

*The balance of the alloy is aluminum and other elements, with the aluminum alloy containing not more than 0.05 wt. % each of any other element, and with the aluminum alloy containing not more than 0.15 wt. % in total of the other elements.

TABLE 25

| Artificial Aging Practices | | |
|---|---|---|
| Alloy | 1st Step | 2nd Step |
| 1980-1 | 250° F. for 24 hours | 350° F. for 6 hours |
| 1980-2 | 400° F. for 10 mins. | 350° F. for 2 hours |
| 1980-3 | 400° F. for 10 mins. | 350° F. for 4 hours |
| 1980-4 | 400° F. for 10 mins. | 350° F. for 6 hours |
| 1980-5 | 420° F. for 7.5 mins. | 350° F. for 4 hours |
| 1980-6 | 380° F. for 10 mins. | 350° F. for 4 hours |
| 1980-7 | 400° F. for 5 mins. | 350° F. for 4 hours |
| 1980-8 | 400° F. for 15 mins. | 350° F. for 4 hours |
| 1980-9 | 420° F. for 7.5 mins. | 350° F. for 2 hours |
| 1980-10 | 420° F. for 7.5 mins. | 350° F. for 6 hours |
| 1980-11 | 370° F. for 10 mins. | N/A |
| 1980-12 | 370° F. for 10 mins. | 310° F. for 2 hours |
| 1980-13 | 360° F. for 10 mins. | 310° F. for 2 hours |
| 1980-14 | 350° F. for 10 mins. | 310° F. for 2 hours |
| 1980-15 | 350° F. for 10 mins. | 310° F. for 4 hours |
| 1980-16 | 350° F. for 30 mins. | 310° F. for 2 hours |
| 1980-17 | 350° F. for 30 mins. | 310° F. for 4 hours |
| 1980-18 | 330° F. for 20 mins. | 310° F. for 2 hours |
| 1980-19 | 330° F. for 20 mins. | 310° F. for 4 hours |
| 1980-20 | 330° F. for 50 mins. | 310° F. for 2 hours |
| 1980-21 | 330° F. for 50 mins. | 310° F. for 4 hours |

For the artificial aging, unless otherwise stated, the samples were heated to the first temperature in about 50 minutes and then held at the stated temperature for the stated amount of time. The samples were then cooled to the second temperature by changing the furnace set-point and opening the furnace door until the second temperature was reached. The specimens were then held at the second temperature for the stated amount of time, after which the samples were removed from the furnace and allowed to air cool to room temperature.

TABLE 26

| Mechanical Properties | | | |
|---|---|---|---|
| Alloy | Tensile Yield Strength (TYS), ksi | Ultimate Tensile Strength (UTS), ksi | Elongation, % |
| 1980-1 | 46.3 | 57.9 | 14.0 |
| 1980-2 | 35.5 | 48.9 | 14.0 |
| 1980-3 | 35.9 | 49.0 | 14.0 |
| 1980-4 | 35.5 | 48.4 | 12.0 |
| 1980-5 | 33.4 | 46.7 | 12.0 |
| 1980-6 | 36.6 | 49.3 | 12.0 |
| 1980-7 | 35.2 | 48.3 | 12.0 |
| 1980-8 | 35.0 | 48.0 | 12.7 |
| 1980-9 | 34.3 | 47.6 | 12.7 |
| 1980-10 | 34.1 | 47.4 | 12.0 |
| 1980-11 | 41.5 | 54.2 | 12.0 |
| 1980-12 | 44.7 | 56.4 | 10.7 |
| 1980-13 | 46.2 | 56.8 | 10.7 |
| 1980-14 | 44.7 | 56.3 | 10.7 |
| 1980-15 | 47.2 | 57.9 | 10.0 |
| 1980-16 | 46.4 | 57.2 | 10.0 |
| 1980-17 | 48.1 | 58.7 | 10.0 |
| 1980-18 | 45.7 | 56.8 | 9.3 |
| 1980-19 | 48.5 | 58.6 | 10.7 |
| 1980-20 | 47.8 | 58.2 | 10.0 |
| 1980-21 | 49.0 | 59.1 | 11.3 |

TABLE 27

| SCC Results | | | | | | |
|---|---|---|---|---|---|---|
| | Hours to Failure | | | | | |
| Alloy | Specimen 1 | Specimen 2 | Specimen 3 | Specimen 4 | Specimen 5 | Specimen 6 |
| 1980-1 | 1 | 1 | 1 | 1 | 1 | 1 |
| 1980-3 | 1.5 | 1.5 | 1.5 | 1.5 | 2.5 | 2.5 |
| 1980-6 | 1.5 | 2 | 2 | 2.5 | 3 | 3.5 |
| 1980-8 | 1.5 | 1.5 | 1.5 | 2 | 2 | N/A |
| 1980-10 | 1.5 | 1.5 | 2 | 2 | 3.5 | 8 |
| 1980-11 | 1 | 1 | 1 | 44 | N/A | N/A |
| 1980-12 | 1 | 1 | 0.5 | 1 | N/A | N/A |
| 1980-13 | 1 | 0.5 | 0.5 | 1 | N/A | N/A |
| 1980-14 | 0.5 | 0.5 | 0.5 | 0.5 | N/A | N/A |
| 1980-15 | 20.5 | 1 | 0.5 | 0.5 | N/A | N/A |
| 1980-16 | 1.5 | 20.5 | 0.5 | 0.5 | N/A | N/A |
| 1980-17 | 0.5 | 1 | 0.5 | 1 | N/A | N/A |
| 1980-18 | 0.5 | 20.5 | 1 | 1 | N/A | N/A |
| 1980-19 | 0.5 | 0.5 | 0.5 | 2.5 | N/A | N/A |
| 1980-20 | 1 | 1.5 | 1 | 1 | N/A | N/A |
| 1980-21 | 1 | 1 | 1 | 1 | N/A | N/A |

As shown, the new aging practice yields significant improvement in throughput via decreased total aging time, and with similar strength and corrosion resistance. Indeed, alloy 1980-21 realizes higher strength than conventionally aged 1980-1, but with only about 4.83 hours of total aging time (not including ramp-up time and cool down time) as compared to the total aging time of 30 hours (not including ramp-up time and cool down time) for alloy 1980-1. The 1980-21 alloy also realizes comparable corrosion resistance to alloy 1980-1.

EXAMPLE 6

Aging of Alloy 1953

Russian alloy 1953 having the composition shown in Table 28 was produced as a conventional rod product (e.g., homogenized, extruded to rod, solution heat treated and cold water quenched) having an outer diameter of about 7.0 inches and a thickness of about 1.3 inches. After about 0.5-1 days of natural aging, the 1953 alloy rod was multi-step aged for various times at various temperatures, as shown in Table 29. After aging, mechanical properties were measured in accordance with ASTM E8 and B557, the results of which are shown in Table 30. Stress corrosion cracking (SCC) resistance was also measured in accordance with ASTM G103, Boiling Salt Test, the results of which are shown in Table 31 (stress in the ST direction and with a stress of 20 ksi), and in accordance with ASTM G44, 3.5% NaCl, Alternate Immersion, the results of which are shown in Table 32 (stress in the ST direction and with a stress of 35 ksi).

TABLE 28

Composition of the 1953 Alloy (in wt. %)*

| Alloy | Zn | Mg | Cu | Zr | Si | Fe | Mn | Cr | Ti |
|---|---|---|---|---|---|---|---|---|---|
| 1953 | 5.76 | 2.65 | 0.55 | 0.02 | 0.04 | 0.08 | 0.17 | 0.20 | <0.01 |

*The balance of the alloy is aluminum and other elements, with the aluminum alloy containing not more than 0.05 wt. % each of any other element, and with the aluminum alloy containing not more than 0.15 wt. % in total of the other elements.

TABLE 29

Artificial Aging Practices

| Alloy | 1st Step | 2nd Step |
|---|---|---|
| 1953-1 | 230° F. for 5 hours | 330° F. for 5 hours |
| 1953-2 | 400° F. for 10 mins. | 330° F. for 2 hours |
| 1953-3 | 400° F. for 10 mins. | 330° F. for 4 hours |
| 1953-4 | 400° F. for 10 mins. | 330° F. for 6 hours |
| 1953-5 | 460° F. for 5 mins. | 330° F. for 4 hours |
| 1953-6 | 430° F. for 7.5 mins. | 330° F. for 4 hours |
| 1953-7 | 400° F. for 5 mins. | 330° F. for 4 hours |
| 1953-8 | 400° F. for 15 mins. | 330° F. for 4 hours |
| 1953-9 | 460° F. for 5 mins. | 330° F. for 2 hours |
| 1953-10 | 460° F. for 7.5 mins. | 330° F. for 6 hours |

For the artificial aging, unless otherwise stated, the samples were heated to the first temperature in about 50 minutes and then held at the stated temperature for the stated amount of time. The samples were then cooled to the second temperature by changing the furnace set-point and opening the furnace door until the second temperature was reached. The specimens were then held at the second temperature for the stated amount of time, after which the samples were removed from the furnace and allowed to air cool to room

TABLE 30

Mechanical Properties

| Alloy | Tensile Yield Strength (TYS), ksi | Ultimate Tensile Strength (UTS), ksi | Elongation, % |
|---|---|---|---|
| 1953-1 | 69.0 | 78.0 | 12.0 |
| 1953-2 | 67.0 | 75.7 | 12.0 |
| 1953-3 | 66.0 | 75.4 | 12.0 |
| 1953-4 | 65.1 | 74.3 | 12.0 |
| 1953-5 | 53.0 | 65.8 | 12.0 |
| 1953-6 | 59.7 | 70.9 | 12.0 |
| 1953-7 | 64.9 | 75.0 | 12.0 |
| 1953-8 | 63.0 | 73.6 | 12.0 |
| 1953-9 | 52.3 | 66.1 | 13.3 |
| 1953-10 | 51.1 | 65.1 | 12.0 |

TABLE 31

SCC Results - ASTM G103

| | Days to Failure | | |
|---|---|---|---|
| Alloy | Specimen 1 | Specimen 2 | Specimen 3 |
| 1953-1 | 0.08 | 0.17 | 0.17 |
| 1953-2 | 0.17 | 0.17 | 0.17 |
| 1953-3 | 0.17 | 0.17 | 0.17 |
| 1953-4 | 0.17 | 0.08 | 0.08 |

TABLE 32

SCC Results - ASTM G44

| | Days to Failure | | | | | |
|---|---|---|---|---|---|---|
| Alloy | Specimen 1 | Specimen 2 | Specimen 3 | Specimen 4 | Specimen 5 | Specimen 6 |
| 1953-1 | DNF | 90 | 90 | N/A | N/A | N/A |
| 1953-2 | DNF | 90 | 90 | N/A | N/A | N/A |
| 1953-3 | 90 | DNF | DNF | N/A | N/A | N/A |
| 1953-4 | 90 | DNF | N/A | N/A | N/A | N/A |
| 1953-5 | DNF | 99 | DNF | DNF | DNF | DNF |
| 1953-6 | DNF | DNF | DNF | 90 | 90 | N/A |
| 1953-7 | 90 | DNF | 90 | 90 | DNF | DNF |
| 1953-8 | 75 | 90 | DNF | 90 | DNF | 90 |
| 1953-9 | DNF | DNF | DNF | DNF | DNF | DNF |
| 1953-10 | DNF | DNF | DNF | DNF | DNF | DNF |

* DNF = did not fail after 140 days

As shown, the new aging practice yields significant improvement in throughput via decreased total aging time, and with similar strength and corrosion resistance. Indeed, alloy 1953-2 realizes about the same strength as conventionally aged 1953-1, but with only about 2.17 hours of total aging time (not including ramp-up time and cool down time) as compared to the total aging time of 10 hours (not including ramp-up time and cool down time) for alloy 1953-1.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed:

1. A method comprising:

(a) casting an aluminum alloy having from 4.0 to 9.5 wt. % Zn, from 1.2 to 3.0 wt. % Mg, and from 1.0 to 2.6 wt. % Cu;

(b) optionally hot working or cold working the aluminum alloy;

(c) after the casting step (a) and the optional step (b), solution heat treating and then quenching the aluminum alloy;

(d) after step (c), optionally working the aluminum alloy;

(e) after step (c) and the optional step (d), artificially aging the aluminum alloy, wherein the artificial aging step (e) comprises:

(i) first aging the aluminum alloy at a first temperature of from 310° F. to 400° F. and for a first aging time of from 1 minute to 120 minutes;

wherein the first aging comprises heating the aluminum alloy to the first temperature at a heating rate of at least 388° F. per hour;

wherein the first aging is the first aging step of the artificial aging;

(ii) second aging the aluminum alloy at a second temperature for a second aging time of at least 30 minutes, wherein the second temperature is lower than the first temperature, wherein the second aging is the second aging step of the artificial aging.

2. The method of claim 1, wherein the first temperature is from 320° to 390° F., and the first aging time is not greater than 90 minutes.

3. The method of claim 1, wherein the first temperature is from 330° to 385° F., and wherein the first aging time is not greater than 60 minutes.

4. The method of claim 1, wherein the first temperature is from 340° to 380° F., and the first aging time is not greater than 30 minutes.

5. The method of claim 1, wherein the second aging temperature is from 250° to 350° F., and the second aging time is from 0.5 to 12 hours.

6. The method of claim 2, wherein the second aging temperature is from 270° to 340° F., and the second aging time is from 1 to 12 hours.

7. The method of claim 3, wherein the second aging temperature is from 280° to 335° F., and the second aging time is from 2 to 8 hours.

8. The method of claim 4, wherein the second aging temperature is from 290° to 330° F., and wherein the second aging time is from 2 to 8 hours.

9. The method of claim 4, wherein the second aging temperature is from 300° to 325° F., and wherein the second aging time is from 2 to 8 hours.

10. The method of claim 1, wherein the aluminum alloy includes from 5.7- 8.4 wt. % Zn, from 1.3 to 2.3 wt. % Mg, and from 1.3 to 2.6 wt. % Cu.

11. The method of claim 10, wherein the aluminum alloy includes from 7.0 to 8.4 wt. % Zn.

12. The method of claim 1, wherein the aluminum alloy is selected from the group consisting of 7×85, 7×55, 7×50, 7×40, 7×99, 7×65, 7×78, 7×36, 7×37, 7×49, and 7×75.

13. The method of claim 1, wherein the aluminum alloy selected from the group consisting of 7×85, 7×55, and 7×65.

14. A method comprising:

(a) casting an aluminum alloy having from 4.0 to 9.5 wt. % Zn, from 1.2 to 3.0 wt. % Mg, and from 0.25 to less than 1.0 wt. % Cu;

(b) optionally hot working or cold working the aluminum alloy;

(c) after the casting step (a) and the optional step (b), solution heat treating and then quenching the aluminum alloy;

(d) after step (c), optionally working the aluminum alloy;

(e) after step (c) and the optional step (d), artificially aging the aluminum alloy, wherein the artificial aging step (e) comprises:

(i) first aging the aluminum alloy at a first temperature of from 330° F. to 430° F. and for a first aging time of from 1 minute to 120 minutes;

wherein the first aging comprises heating the aluminum alloy to the first temperature at a heating rate of at least 388° F. per hour;

wherein the first aging is the first aging step of the artificial aging;

(ii) second aging the aluminum alloy at a second temperature for a second aging time of at least 30 minutes, wherein the second temperature is lower than the first temperature, wherein the second aging is the second aging step of the artificial aging.

15. The method of claim 14, wherein the first temperature is from 340° to 425° F., and the first aging time is not greater than 90 minutes.

16. The method of claim 14, wherein the first temperature is from 350° to 420° F., and the first aging time is not greater than 60 minutes.

17. The method of claim 14, wherein the first temperature is from 360° to 415° F., and the first aging time is not greater than 30 minutes.

18. The method of claim 14, wherein the second aging temperature is from 250° to 370° F., and the second aging time is from 0.5 to 12 hours.

19. The method of claim 14, wherein the second aging temperature is from 270° to 360° F., and the second aging time is from 1 to 12 hours.

20. The method of claim 15, wherein the second aging temperature is from 280° to 355° F., and the second aging time is from 2 to 8 hours.

21. The method of claim 16, wherein the second aging temperature is from 290° to 350° F., and the second aging time is from 2 to 8 hours.

22. The method of claim 17, wherein the second aging temperature is from 300° to 345° F., and the second aging time is from 2 to 8 hours.

23. The method of claim 14, wherein the aluminum alloy is selected from the group consisting of 7×41 and. RU1953.

24. A method comprising:

(a) casting an aluminum alloy having from 4.0 to 9.5 wt. % Zn, from 1.2 to 3.0 wt. % Mg, and less than 0.25 wt. % Cu;

(b) optionally hot working or cold working the aluminum alloy;

(c) after the casting step (a) and the optional step (b), solution heat treating and then quenching the aluminum alloy;

(d) after step (c), optionally working the aluminum alloy;

(e) after step (c) and the optional step (d), artificially aging the aluminum alloy, wherein the artificial aging step (e) comprises:

(i) first aging the aluminum alloy at a first temperature of from 310° F. to 400° F. and for a first aging time of from 1 minute to 120 minutes;

wherein the first aging comprises heating the aluminum alloy to the first temperature at a heating rate of at least 388° F. per hour;

wherein the first aging is the first aging step of the artificial aging;

(ii) second aging the aluminum alloy at a second temperature for a second aging time of at least 30 minutes, wherein the second temperature is lower than the first temperature, wherein the second aging is the second aging step of the artificial aging.

25. The method of claim 24, wherein the first temperature is from 320° to 390° F., and the first aging time is not greater than 90 minutes.

26. The method of claim 24, wherein the first temperature is from 330° to 385° F., and the first aging time is not greater than 60 minutes.

27. The method of claim 24, wherein the first temperature is from 340° to 380° F., and the first aging time is not greater than 30 minutes.

28. The method of claim 24, wherein the second aging temperature is from 250° to 350° F., and the second aging time is from 0.5 to 12 hours.

29. The method of claim 25, wherein the second aging temperature is from 270° to 340° F., and the second aging time is from 1 to 12 hours.

30. The method of claim 26, wherein the second aging temperature is from 280° to 335° F., and the second aging time is from 2 to 8 hours.

31. The method of claim 26, wherein the second aging temperature is from 290° to 330° F., and the second aging time is from 2 to 8 hours.

32. The method of claim 27, wherein the second aging temperature is from 300° to 325° F., and the second aging time is from 2 to 8 hours.

33. The method of claim 24, wherein the aluminum alloy is selected from the group consisting of 7×05, 7×39, and 7×47, and RU1980.

* * * * *